United States Patent [19]

Rockl et al.

[11] 4,081,775

[45] Mar. 28, 1978

[54] APPARATUS FOR DAMPING THE BOUNCING OR CHATTER OF RELAY ARMATURES IN THE RELEASING POSITION

[75] Inventors: Friedrich Röckl; Helmut Stocker, both of Munich; Gundokar Braumann, Neuried, all of Germany

[73] Assignee: Siemens Aktiengesellschaft, Munich, Germany

[21] Appl. No.: 780,987

[22] Filed: Mar. 24, 1977

[30] Foreign Application Priority Data

Mar. 31, 1976 Germany ..... 2613808

[51] Int. Cl.[2] ..... H01F 7/08

[52] U.S. Cl. ..... 335/271; 335/277

[58] Field of Search ..... 335/270, 271, 276, 277

[56] References Cited

U.S. PATENT DOCUMENTS

| | | | |
|---|---|---|---|
| 3,148,313 | 9/1964 | Hancock | 335/271 X |
| 3,259,812 | 7/1966 | O'Neil | 335/270 X |
| 3,675,172 | 7/1972 | Petusky | 335/277 X |
| 3,818,397 | 6/1974 | Roslin | 335/277 X |

*Primary Examiner*—George Harris

*Attorney, Agent, or Firm*—Schuyler, Birch, Swindler, McKie & Beckett

[57] ABSTRACT

The present invention is directed to an improved electromagnetic relay having means for eliminating the chatter or bounce of the relay armature upon the movement of the relay armature from its energized position to its rest position, that is, the releasing or returning movement of the relay armature. An armature stopping means is formed by two resilient strips which deflect in response to the returning movement of the relay armature. This deflection of these resilient strips stores energy in these resilient strips for returning the relay armature to its initial rest position. In addition to these two resilient strips, the armature stopping means of the present invention includes means for generating independent counter forces which oppose the deflection of these resilient strips. One of these counter forces is a frictional force generated by the abuttment of a bent flange forming part of each of the resilient strips against rigid mounting elements for mounting the two resilient strips. Another counter force is generated by additional bent flanges which connect these resilient strips to the rigid mounting elements. Finally, the counter forces generated by the present invention are influenced by the bending strengths of the resilient strips.

5 Claims, 2 Drawing Figures

APPARATUS FOR DAMPING THE BOUNCING OR CHATTER OF RELAY ARMATURES IN THE RELEASING POSITION

BACKGROUND OF THE INVENTION

The present invention is concerned with a device for eliminating the chatter or bounce of a relay armature which is returning from its energized position to its rest position. In general, chatter or bounce during the impact of masses affects the life of mechanical equipment, more particularly, as far as relay armatures are concerned, chatter affects the life of the surfaces at the points of contact. Another special problem also occurs in electrical circuits having a mechanical contact such as a relay contact when the mechanical contact is in the closed position. Chatter at this mechanical contact results in the repititious opening and closing of the electrical circuit. This produces spark formations, welding processes, transfer of material at the contact point and, frequently, undesirable burst noises within the electrical circuit.

The actuation of a relay armature in the direction of energization, which is caused by the magnetic forces of the relay coil, usually does not result in substantial bounce or chatter since in this position the relay armature is continually exposed to considerable magnetic forces. On the other hand, upon returning to its rest position, the relay armature is subject to the force of the armature spring which is designed so weak that its force, which opposes the armature energization, affects the response sensitivity and pickup time of the relay. This exerts great influence on the amplitude of the rebounces on impact of the armature with its stop. Thus, during the release of the armature, the relay contacts may again be actuated by the rebound from the rest side stop, resulting in all of the above disadvantages which deleteriously affect the life and functional capability of the relay.

Past devices have attempted to minimize the problem of the tendency of relay armatures to bounce by placing additional masses on the relay armature which were capable of moving independently thereof. For example, it is possible to attach freely moving masses in casings to the relay armature. The movement of these freely moving masses lags behind the particular movement of the relay armature and produces a counter force when the armature rebounces. Also, by means of bent springs an additional overshooting mass may be placed on the relay armature. However, all these previous solutions suffer the disadvantage that they adversely affect the response of the relay armature to energization due to the additional masses placed on the armature. As a result, higher energies must be generated for the excitation of the relay. Apart from these higher energies, cost disadvantages accrue due to the increased size of these relays due primarily to the change of the cross sectional area of the relay coil.

The arrangement of additional masses on relay armatures also appears virtually impossible in the case of minature relays which have found increasingly wide application. The adjustment and checking of these additional masses to ensure the proper functioning of the relay are accompanied by precise mechanical problems which cannot be economically solved. In particular, these relays operate with very small air gaps due to their small size and, as a rule, their armatures must be designed to ensure extra positive contact making. To this end, these relays often employ springs fitted over the socket contacts to increase spring travel. However, in these relays, even a minimum susceptibility to rebounce during release causes the contact to close again with all the attendant disadvantages described hereinabove.

Accordingly, it is an object of the present invention to develop a suitable solution for damping the releasing movement of relay armatures in order to avoid the bounces or chatter that may cause the relay contact to close again.

SUMMARY OF THE INVENTION

The objects of the present invention are achieved by providing a rest stop for the relay armature which is formed by the movable region of at least one resilient strip whose deflection or evading movement caused by the resetting movement of the armature is influenced by various forces independent of one another which oppose such deflection or evading movement.

A considerable advantage of the device according to the present invention is the fact that the armature masses, spring tensions and air gap dimensions which determine the functional capability of the relay are independent of the damping device. This independence in no way effects the functional or operational zone of the relay since in the rest position the relay armature bears directly against the stop (the same position as if the stop were rigid) and goes from there to its operating position without in the least being influenced by the device constructed in accordance with the invention. Thus, since there is no variation in the armature mass or in the spring tension or in the dimensions of the air gap, all the original design values of the relay are preserved. Not until the relay armature releases and is outside the functional or operational zone does the device according to the present invention become effective by establishing forces opposing the further movement of the armature. If necessary, various counter forces independent of one another are explicitly provided so as to prevent bounce or chatter. Thus, the device according to the present invention provides the relay armature with a range of movements which occurs outside the functional or operational zone and which permits the armature movement to die out by converting the kinetic energy associated with the moving relay armature to other forms of energy.

Conveniently, at least one of the counter forces may be produced by a bent flange of a strip whose surface extends parallel to the movement of the armature and bears against rigid mounting elements in a non-positive manner. The device described hereinabove produces a frictional force as one of the independent counter forces. Frictional forces are particularly suitable for converting kinetic energy into heat without producing forces which could possibly cause the armature mass to bounce back to its other position. The above described device with the bent flange is not only easy to make, but an additional advantage is that the frictional force described above is produced by holding elements formed on the rigid mounting element so that the adjustment of the frictional force can be controlled by the design of the holding elements.

According to another preferred embodiment of the present invention, the strip or strips may be located on the side of the rigid mounting elements facing away from the functional or operational zone of the armature. As a result, additional counter forces may be produced by flanges formed on the strip or strips which are positively connected with the rigid mounting elements. Several advantages result from this arrangement including the development of spring tension in the strip or strips that opposes the movement of the armature beyond its original or initial rest position. On the other hand, any such movement of the armature in the above direction stores energy in the strip or strips for restoring the armature to its original position. This restoring energy overcomes the frictional forces so as to reset the armature to its original rest position.

Another advantage resulting from this arrangement is that another counter force is determined by adjusting the bending strength of the strip or strips in the area extending between the points of attachment to the rigid mounting elements, that is, between the flanges positively connected with the rigid mounting elements.

According to a preferred embodiment of the present invention, the armature stop may be a rectangular spring steel frame part having two strips extending along opposite sides. These strips are each securely fastened via two flanges to two rigid mounting elements (e.g. ceramic rolls). These rigid mounting elements extend parallel to these strips. In addition, one bent flange in each strip bears against these rigid mounting elements in a direction parallel to the direction of movement of the armature against the armature stop. Another flange projecting from one of the joints between the ends of the two strips into the interior of the rectangle serves as a retaining and resetting spring for the armature. The design of the device according to the present invention, which eliminates bouncing or chatter, is particularly suited for making miniature relays since both the retaining spring of the armature and the armature stop are made from one pressed part which can be shaped to its final form with relatively few bending operations.

DETAILED DESCRIPTION OF THE INVENTION

Figure 1:
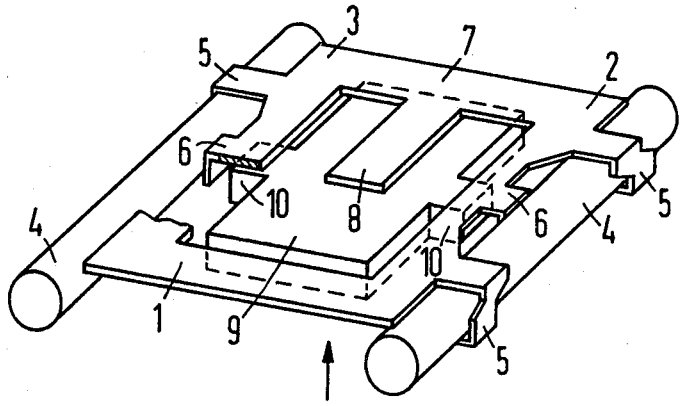
FIG. 1 is a perspective view of the relay damping apparatus of the present invention including the relay armature and the armature stop.

FIG. 1 shows at 1 a frame-like pressed part of spring steel. This pressed part 1 is shaped like a rectangle and has two strips 2 and 3 extending parallel to two round rigid mounting elements 4, such as ceramic rolls, which in a manner not shown are stored in the housing of the relay. The flanges 5 which form part of each of the strips 2 and 3 embrace the mounting elements 4 and, together with the bent off flanges 6, hold the frame-like pressed part 1 on the mounting elements 4. The flanges 5 in the region where the mounting elements 4 are embraced are staggered such that a greater or larger spring length arises when the spring is placed under tension. As apparent from the cut out portion of the strip 3 on the left of FIG. 1, the bent flanges 6 form frictional surfaces which bear against the mounting elements 4. Starting out from the joint 7 between the two strips 2 and 3, there projects into the interior of the frame-like part 1 a flange 8 and an armature 9 welded together. Flange 8 functions as a spring for armature 9. The armature 9 is made from ferromagnetic material and its movement is influenced by the magnetic flux produced upon the energization of the relay coil. As shown in FIG. 1, in the rest position, armature 9 has two shoulders 10 approximately in the region of the flanges 6 which bear against strips 2 and 3. In its other energized position, armature 9 is withdrawn from the abutting engagement with the strips 2 and 3 to a position which operates the relay contacts (not shown) by bridging over these relay contacts. After the armature 9 is released by the deenregization of the relay, the restoring energy of spring 8 together with the mass of the armature 9 itself will result in a given energy of impact on the shoulders 10 of armature 9. Strips 2 and 3 avoid the stress which results from this impact by deflecting or moving in the direction of the arrow shown in FIG. 1. At the same time, flange 6 opposes this deflection or evading movement and, due to friction, converts a portion of the energy into heat. The flanges 5 act as tension springs for storing a restoring energy which enables the strips 2 and 3 to make this deflection or evading movement. The bending or twisting of these resilient strips 2 and 3 enables these strips to store the energy.

Figure 2:
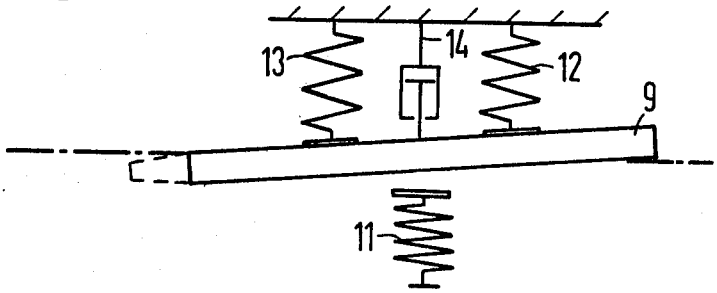
FIG. 2 is a schematic diagram of the relay of the present invention which illustrates the forces used for damping the bounce or chatter of a relay armature.

FIG. 2 is a diagram of the relay of the present invention which shows how the above forces occur. Armature 9 is influenced by restoring force 11 until the rest position shown by the dash-dotted line is reached. From there the spring forces 12 and 13 become effective and upon further movement of the armature 9 they store energy in the damping area so as to ensure the resetting of the armature to the rest position. Moreover, a frictional force 14 becomes effective in the damping area which damps in both directions the movements of the armature.

The improved performance of a relay according to the present invention is due to the fact that the armature 9 upon actuation is influenced only by the tension of spring 11, which represents the spring force of flange 8 in FIG. 1. Since the armature 9 is free of all other forces, its response sensitivity is not influenced by the damping effect of any such other forces.

Although an illustrative embodiment of the present invention has been described with reference to the accompanying drawings, it is to be understood that the invention is not limited to this precise embodiment and that various changes and modifications may be effected therein by one skilled in the art without departing from the scope or spirit of the invention. For example, it is to be understood that the pressed part 1 carrying the armature 9 and attached to the mounting elements 4 may be formed in a manner other than as shown in FIG. 1. For example, the armature spring 8 connected to the armature 9 may take other shapes in order to achieve a greater spring length and thereby achieve greater softness. Also, the design of the flanges which act as spring elements and the strips 2 and 3 which also act as spring elements may be varied in accordance with the given requirements of the particular relay.

We claim:

1. In an electromagnetic relay having an electromagnetic coil and a relay armature, said relay armature being capable of moving from a rest position to an energized position upon energization of said coil and returning to said rest position upon deenergization of said coil, the improvement comprising:

armature stopping means located at said rest position for eliminating the chatter or bounce of the relay armature at the rest position by stopping the returning movement of said relay armature from said energized position to said rest position, said armature stopping means comprising at least one resilient strip capable of deflecting in response to the returning movement of said relay armature, whereby said deflection of said at least one resilient strip stores energy in said resilient strip for stopping said relay armature in said rest position, said armature stopping means further comprising means for generating independent counter forces opposing the deflection of said at least one resilient strip, whereby said counter force generating means and said at least one resilient strip interact to eliminate the bounce or chatter of said relay armature upon returning to said rest position.

2. An electromagnetic relay according to claim 1 wherein said armature stopping means further comprises rigid mounting means for mounting said at least one resilient strip, said counter force generating means further comprising a bent flange connected to said at least one resilient strip for generating frictional forces opposing the deflection of said at least one resilient strip, said bent flange having a surface extending parallel to the movement of said relay armature which abutts said rigid mounting means, whereby said frictional force is generated between said bent flange and said rigid mounting means.

3. An electromagnetic relay according to claim 2 wherein said at least one resilient strip is connected on the side of said rigid mounting means in a position facing away from the operational region of said relay armature, said counter force generating means further comprising a second bent flange forming part of said at least one resilient strip, said second bent flange being securely fastened to said rigid mounting means.

4. An electromagnetic relay according to claim 1 wherein said counter force generating means is influenced by the bending strength of said at least one resilient strip.

5. An electromagnetic relay according to claim 1 wherein said armature stopping means is a rectangular spring-steel frame having two resilient strips extending along two opposite sides of said frame, each of said resilient strips being securely fastened to a rigid mounting means via two bent flanges, said rigid mounting means extending parallel to said resilient strips, each of said resilient strips further including another bent flange having a surface extending parallel to the movement of said relay armature, said surface being positioned to abutt against said rigid mounting means for generating a frictional force opposing the deflection of said two resilient strips, said frame further comprising a spring flange projecting into the interior of said rectangular spring steel frame for retaining said relay armature and enabling said relay armature to return from its energized position to its rest position.

* * * * *